United States Patent [19]

Van Dijk

[11] Patent Number: 4,922,948

[45] Date of Patent: May 8, 1990

[54] FLOOR DRAIN AND TRAP

[76] Inventor: Willem Van Dijk, 6690 Fran Dr., Macon, Ga. 31206

[21] Appl. No.: 360,137

[22] Filed: Jun. 1, 1989

[51] Int. Cl.[5] ..... F16K 13/10

[52] U.S. Cl. ..... 137/247.33; 137/362; 137/550

[58] Field of Search ..... 137/247.11, 247.27, 137/247.33, 247.41, 247.43, 247.45, 362, 549, 550, 247.51, 254; 210/163, 164, 247

[56] References Cited

U.S. PATENT DOCUMENTS

| | | | |
|---|---|---|---|
| 56,225 | 7/1866 | Hunt | 137/247.33 X |
| 417,441 | 12/1889 | Reader | 137/247.33 X |
| 814,481 | 3/1906 | Savard | 137/247.11 X |
| 951,795 | 3/1910 | Berwanger | 137/247.33 X |
| 1,051,757 | 1/1913 | Powers | 137/362 X |
| 1,328,262 | 1/1920 | Boosey | 137/362 X |
| 1,411,125 | 3/1922 | O'Brien | 137/247.33 X |
| 1,537,955 | 5/1925 | Luff | 137/247.47 |
| 1,951,253 | 3/1934 | Odenkirk | 137/247.43 |
| 3,042,210 | 7/1962 | Hattori | 210/163 |
| 4,043,354 | 8/1977 | Brown | 137/247.33 |
| 4,248,711 | 2/1981 | Fitzpatrick | 137/247.27 X |
| 4,263,138 | 4/1981 | Kessel | 137/247.27 X |
| 4,487,219 | 12/1984 | Mäkeliä et al. | 137/362 |
| 4,700,412 | 10/1987 | Manvel | 137/247.51 |

FOREIGN PATENT DOCUMENTS

| | | | |
|---|---|---|---|
| 2654670 | 6/1978 | Fed. Rep. of Germany | 137/247.43 |
| 273026 | 4/1951 | Switzerland | 137/247.33 |
| 934 | of 1902 | United Kingdom | 137/247.33 |

*Primary Examiner*—John Rivell

*Attorney, Agent, or Firm*—Leon Gilden

[57] ABSTRACT

A floor drain and trap organization is set forth including a housing provided with outwardly extending flanges for securement to an existing floor structure. A removable drain lid is provided with a series of circumferentially arranged apertures overlying a first drain channel in communication with an upwardly extending second drain channel for directing water flow into a medially positioned conduit extending upwardly through the housing and arranged below the drain lid. A variety of filtration screens are utilized dependent upon flow conditions in use of the organization.

3 Claims, 4 Drawing Sheets

FLOOR DRAIN AND TRAP

BACKGROUND OF THE INVENTION

1. Field of the Invention

The field of invention relates to floor drains, and more particularly pertains to a new and improved floor drain and trap to provide a volume of water within the trap to prevent sewage gases from entering an interior surface of a dwelling.

2. Description of the Prior Art

The use of drainage traps and various floor drains is well known in the prior art. Heretofore the prior art, however, has failed to set forth a uniquely effective organization, as provided by the instant invention, to maintain a volume of water within a drainage system to prevent sewage vapors from entering a dwelling, as well as providing various and effective screening arrangements for use with the drain to accommodate various flow conditions. For example, U.S. Pat. No. 4,487,219 to Makela, et al., sets forth a floor drain provided with a cup-like drain with a laterally oriented drainage conduit with a water seal wall positioned below the conduit to maintain a volume of water within the organization.

U.S. Pat. No. 1,951,253 to Odenkirk sets forth a self-cleaning trap wherein an unobstructured interior body formed with an outlet and an inlet at opposed sides with an inner vertically disposed wall extending downwardly to a point in horizontal alignment with the outlet portion preventing escape of sewer gas into a dwelling.

U.S. Pat. No. 1,537,955 to Luff sets forth an elbow-type drain provided with coaxial lower and upper vertical portions of decreasing cross-sectional area to maintain a level of water therein to prevent obnoxious gases from entering a dwelling.

U.S. Pat. No. 4,263,138 to Kessel sets forth a drain fitting provided with a medial downwardly extending conduit cooperating with a peripheral cylindrical conduit directing a flow of fluid therethrough while maintaining a level of water preventing entry of noxious gases into a dwelling.

U.S. Pat. No. 4,248,711 to Fitzpatrick sets forth a drain trap provided within a basement with an outlet drain positioned at a level above a reservoir of fluid to prevent entry of noxious gases into a residence and the like.

As such, it may be appreciated that there is a continuing need for a new and improved floor drain and trap as set forth by the instant invention which addresses both the problems of ease of use and effectiveness in construction, and in this respect, the present invention substantially fulfills this need.

SUMMARY OF THE INVENTION

In view of the foregoing disadvantages inherent in the known types of floor drains now present in the prior art, the present invention provides a floor drain and trap wherein the same maintains a reservoir of water within the apparatus to prevent noxious gases from entering a dwelling and further provides for various filtration screens to accommodate a variety of flow conditions. As such, the general purpose of the present invention, which will be described subsequently in greater detail, is to provide a new and improved floor drain and trap which has all the advantages of the prior art floor drains and none of the disadvantages.

To attain this, the present invention comprises a floor drain and trap utilizing a top flange provided with a removably mounted drainage lid wherein the drainage lid is formed with a series of through-extending apertures proximate a terminal exterior edge of the lid. The lid overlies a central conduit with a downwardly extending skirt formed within a housing of the organization positioned between the central conduit and a first conduit underlying the apertures to maintain a preselected level of water within the housing of the organization preventing noxious gases from entering a dwelling. A series of filtration members are provided to accommodate various flow conditions to overlie the central conduit in a close fitting arrangement, or alternatively, in a surrounding relationship, or alternatively, with a pyramidal projection directed interiorly of the conduit to provide enhanced flow through the conduit and the associated filtration screen.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved floor drain and trap which has all the advantages of the prior art floor drains and none of the disadvantages.

It is another object of the present invention to provide a new and improved floor drain and traps which may be easily and efficiently manufactured and marketed.

It is a further object of the present invention to provide a new and improved floor drain and trap which is of a durable and reliable construction.

An even further object of the present invention is to provide a new and improved floor drain and trap which is susceptible of a low cost of manufacture with regard to both materials and labor, and which accordingly is then susceptible of low prices of sale to the consuming public, thereby making such floor drains and traps economically available to the buying public.

Still yet another object of the present invention is to provide a new and improved floor drain and trap which provides in the apparatuses and methods of the prior art some of the advantages thereof, while simultaneously overcoming some of the disadvantages normally associated therewith.

Still another object of the present invention is to provide a new and improved floor drain and trap wherein the same maintains a volume of water preventing entry of noxious gases from entering a dwelling, and further provides for various filtration screens to be utilized in junction with the trap to accommodate various flow conditions through the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
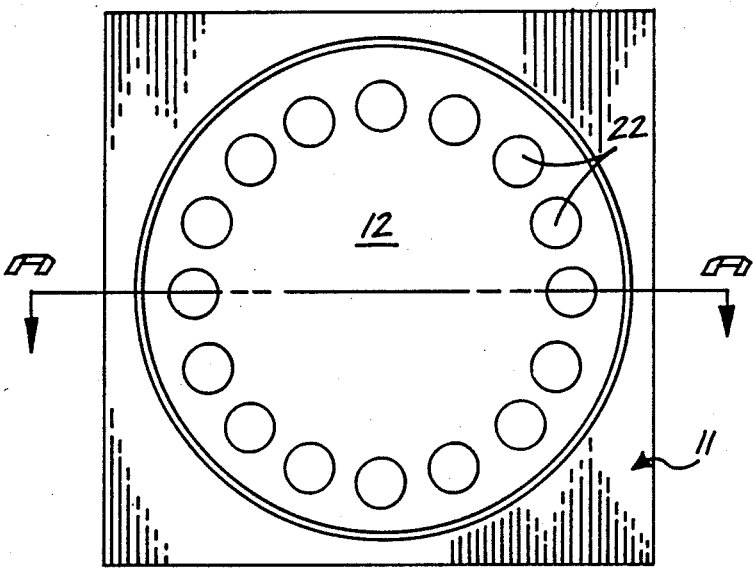
FIG. 1 is a top orthographic view of the instant invention.
Figure 2:
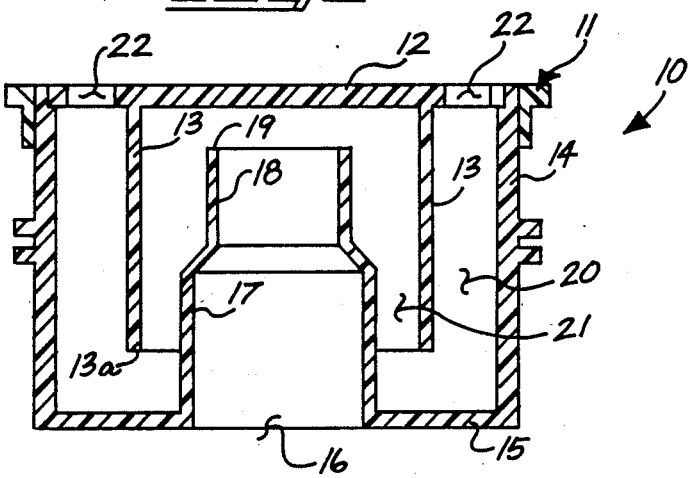
FIG. 2 is an orthographic view taken along the lines A—A of FIG. 1 in the direction indicated by the arrows.

With reference now to the drawings, and in particular to FIGS. 1 to 8 thereof, a new and improved floor drain and trap embodying the principles and concepts of the present invention and generally designated by the reference numerals 10, 10*a*, 10*b*, and 10*c* will be described.

More specifically, the floor drain and trap 10 of the instant invention essentially comprises a housing 11 including a peripherally extending flange at an uppermost edge of the housing for securement to an existing floor structure aligned with an annular removable drainage lid 12. The housing 11 includes a cylindrical body 14 extending downwardly aligned with an outer terminal edge of the lid 12 and terminating with an integral floor 15. A cylindrical skirt 13 is integrally secured to and extends downwardly and orthogonally relative to the lid 12 and is formed with a terminal end 13*a* oriented a first distance above the floor 15. The floor 15 is formed with a central annular floor opening 16 in communication with an upwardly extending conduit 17 of a first diameter tapering into an upper section 18 of a reduced second diameter with the upper section 18 including a top terminal end 19 spaced below the lower surface of the drainage lid 12. The cylindrical chamber defined between the skirt 13 and the interior surface of the cylindrical body 14 defines a first channel 20 in communication with an upwardly extending second channel 21 defined between an interior surface of the skirt 13 and an exterior surface of the conduit 17 and the tapered section 18. The lid 12 is accordingly provided with a series of through-extending apertures 22 overlying the first channel 20 to direct fluid to be drained therethrough and subsequently through the second channel 21 and upon rising to a level equal to or exceeding the top terminal end 19 of the upper section 18, drains downwardly through the floor opening 16 and into existing sewage conduits (not shown).

Figure 3:
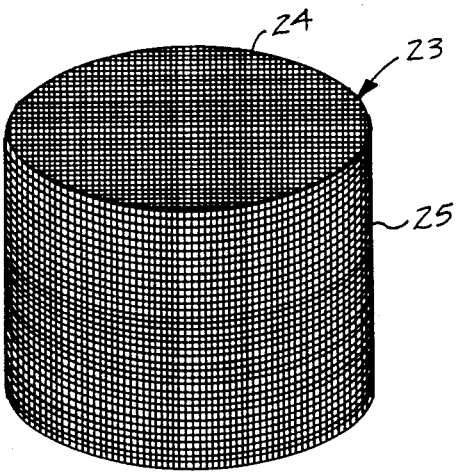
FIG. 3 is an isometric illustration of a filtration screen utilized by the instant invention.
Figure 4:
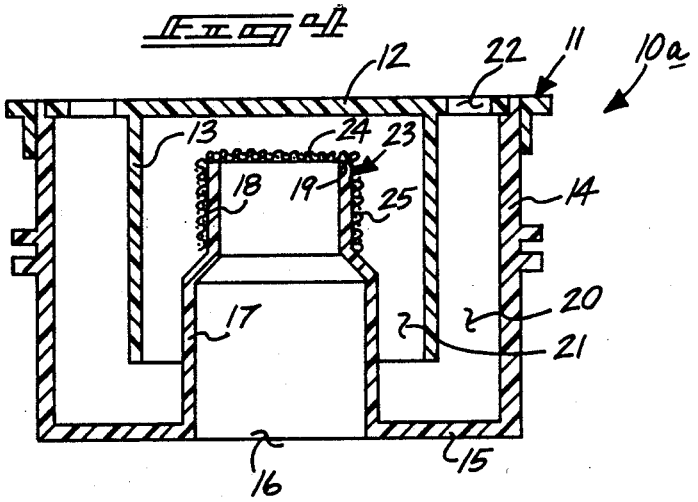
FIG. 4 is an orthographic view of a modification of the instant invention taken along the lines A—A of FIG. 1 in the direction indicated by the arrows.
Figure 5:
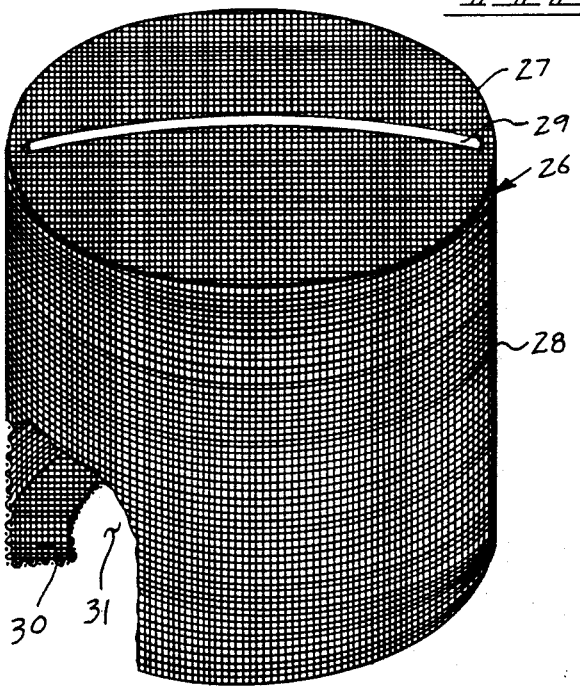
FIG. 5 is an isometric illustration of a further filtration screen utilized by the instant invention.

Attention to FIGS. 3 and 4 illustrates a cylindrical first screen 23 for use in combination with the organization which essentially includes a planar top screen 24 with an orthogonally and downwardly depending cylindrical skirt 28 of an internal diameter equal to an external diameter defined by the upper section conduit 18 and of a length equal to the axial length of the tapered upper section conduit 18 to securely fit thereover.

Figure 6:
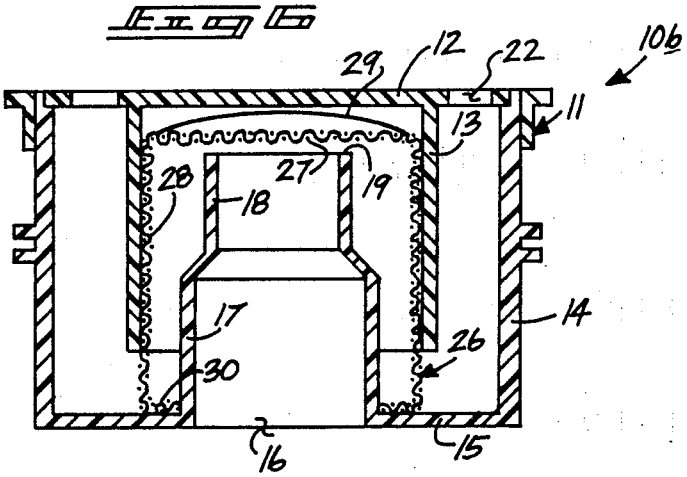
FIG. 6 is an orthographic view of a modification of the instant invention taken along the lines A—A of FIG. 1 in the direction indicated by the arrows.
Figure 7:
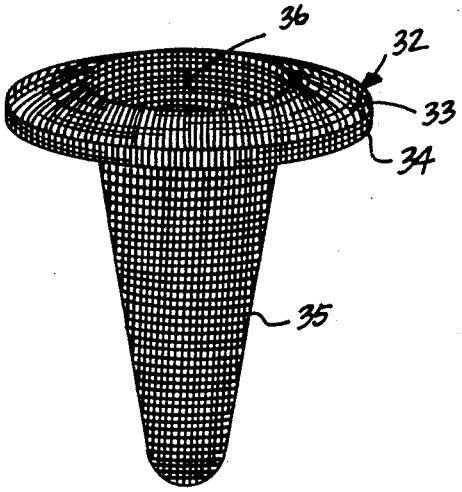
FIG. 7 is an isometric illustration of yet a further filtration screen utilized by the instant invention.

Attention to FIGS. 6 and 7 illustrates a second screen 26 of a generally cylindrical external configuration including a planar top 27 with a downwardly depending cylindrical skirt 28, wherein the cylindrical skirt 28 of the second screen 26 is of an external diameter equal to an internal diameter defined interiorly of the cylindrical skirt 13 of the drainage lid 12. The planar top 27 is provided with a handle 29, and the cylindrical skirt 28 terminates at its lowermost end with a screen floor 30 defining a screen aperture 31 of a diameter equal to a diameter defined by the external diameter of the conduit 17. The height of the second screen 26 is greater than that defined by the conduits 17 and 18, but less than that defined between the floor 15 and the interior surface of the lid 12 to enable secure positioning of the second screen 26 to overlie the conduit structures 17 and 18 respectively. The second screen 28 provides a greater flow area defined between the lower terminal end 13*a* of the cylindrical skirt 13 and the upper surface of the floor 15, wherein the planar top 27 and the screen floor 30 provide for secure positioning of the second screen 26 in place, as illustrated within the floor drain and trap 10*b*.

Figure 8:
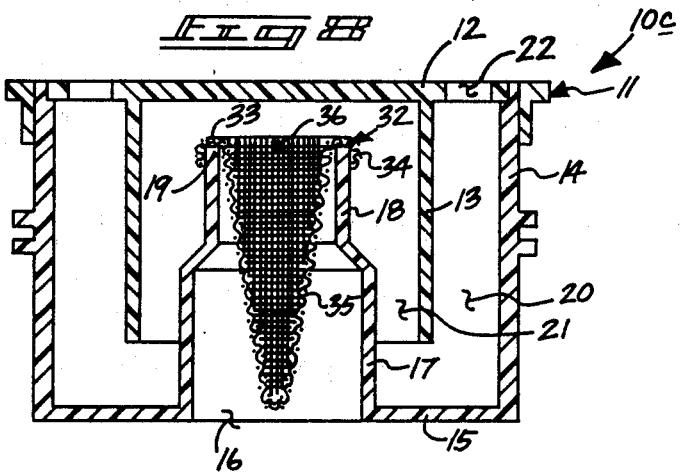
FIG. 8 is an orthographic view taken along the lines A—A of FIG. 1 of a further modification of the instant invention.

Attention to FIGS. 7 and 8 illustrates yet another embodiment utilizing a third screen 32 provided with a deformable arcuate top terminating in a downwardly depending flange 34 that is manually manipulated to provide for a secure and grasping fit overlying the top terminal end 19 of the upper section conduit 18. The third screen 32 includes a cylindrical screen opening 36 defined medially of the arcuate top 23 and includes a downwardly depending enclosed conical body 35 of a height substantially equal to or less than the axial height of the conduits 17 and 18. It may be appreciated that the conical body 35 provides for an enhanced surface area to enable improved fluid flow therethrough.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

I claim:

1. A floor drain comprising, a housing including an encircling exterior wall wherein the wall terminates at an upper end thereof in an orthogonally disposed flange extending outwardly of the exterior wall, the exterior wall including an integrally connected floor spaced below the flange a fixed distance, the floor including a central floor opening defining a floor diameter, and a circular lid aligned with the flange and including a circular array of lid apertures oriented adjacent a terminal edge of the lid, and the lid including a downwardly extending lid skirt integrally secured to a bottom surface of the lid defining a cylinder of a predetermined skirt diameter wherein the lid skirt is oriented interiorly of the skirt apertures within the lid, and wherein the lid skirt defines a skirt length spaced above the floor, and an upwardly extending first conduit integrally formed to and axially aligned with the floor opening, and the first conduit defining a first conduit diameter equal to the floor diameter, and the first conduit extending above a lower terminal end of the lid skirt, and wherein the first conduit includes a second conduit of a diameter less than the first conduit diameter coaxially aligned with and integrally formed to the first conduit wherein the second conduit is spaced below the bottom surface of the lid, and wherein the lid skirt spaced interiorly of the encircling exterior wall defines a first channel, and the first channel is in communication with a second channel, the second channel defined by a spacing between an interior surface of the lid skirt and an exterior surface of the first and second conduits, and wherein the lid, the second conduit, the first conduit, and the floor opening are each coaxially aligned relative to one another, and further including a first screen, the first screen defining a cylindrical vertical wall and a planar top connecting wall, and the cylindrical wall defining an inner diameter equal to an exterior diameter of the second conduit and of a length equal to a length defined by the second conduit.

2. A floor drain comprising, a housing including an encircling exterior wall wherein the all terminates at an upper end thereof in an orthogonally disposed flange extending outwardly of the exterior wall, the exterior wall including an integrally connected floor spaced below the flange a fixed distance, the floor including a central floor opening defining a floor diameter, and a circular lid aligned with a flange and including a circular array of lid apertures oriented adjacent a terminal edge of the lid, and the lid including a downwardly extending lid skirt integrally secured to a bottom surface of the lid defining a cylinder of a predetermined skirt diameter wherein the lid skirt is oriented interiorly of the skirt apertures within the lid, and wherein the lid skirt defines a skirt length spaced above the floor, and an upwardly extending conduit integrally formed to and axially alinged with the floor opening, and the first conduit defining a first conduit diameter equal to the floor diameter, and the first conduit extending above a lower terminal end of the lid skirt, wherein the first conduit includes a second conduit of a diameter less than the first conduit diameter coaxially aligned with and integrally formed to the first conduit wherein the second conduit is spaced below the bottom surface of the lid, and wherein the lid skirt spaced interiorly of the encircling exterior wall defines a first channel, and the first channel is in communication with a second channel, the second channel defined by a spacing between an interior surface of the lid skirt and an exterior surface of the first and second conduits, and and wherein the lid, the second conduit, the first conduit, and the floor opening are each coaxially aligned relative to one another, and including a screen of a height greater than a combined length defined by the first and second conduits, and defining a cylindrical screen wall of a diameter equal to the skirt diameter, and a handle integrally secured to the screen, and the screen terminating at a lowermost end in a screen floor, the screen floor including a screen central opening wherein the central opening is of a central opening diameter equal to an external diameter of the first conduit.

3. A floor drain comprising, a housing including an encircling exterior wall wherein the wall terminates at an upper end thereof in an orthogonally disposed flange extending outwardly of the exterior wall, the exterior wall including an integrally connected floor spaced below the flange a fixed distance, the floor including a central floor opening defining a floor diameter, and a circular lid aligned with the flange and including a circular array of lid apertures oriented adjacent a terminal edge of the lid, and the lid including a downwardly extending lid skirt integrally secured to a bottom surface of the lid defining a cylinder of a predetermined skirt diameter wherein the lid skirt is oriented interiorly of the skirt apertures within the lid, and wherein the lid skirt defines a skirt length spaced above the floor, and an upwardly extending first conduit integrally formed to and axially aligned with the floor opening, and the first conduit defining a first conduit diameter equal to the floor diameter, and the first conduit extending above a lower terminal end of the lid skirt, wherein the first conduit includes a second conduit of a diameter less than the first conduit diameter coaxially alinged with and integrally formed to the first conduit wherein the second conduit is spaced below the bottom surface of the lid, and wherein the lid skirt spaced interiorly of the encircling exterior wall defines a first channel, and the first channel is in communication with a second channel, the second channel defined by a spacing between an interior surface of the lid skirt and an exterior surface of the first and second conduits, and wherein the lid, the second conduit, the first conduit, and the floor opening are each coaxially aligned relative to one another, and including a conical screen wherein the conical screen includes a manually malleable acruate top, the arcuate top terminating in a downwardly extending flange, the arcuate top further including an arcuate top opening of a diameter substantially equal to the second conduit diameter, and a conical screen body depending orthogonally downwardly from the acruate top and of a length greater than the second conduit but spaced above the floor opening.

* * * * *